US011381008B2

(12) United States Patent
Kloppenburg et al.

(10) Patent No.: US 11,381,008 B2
(45) Date of Patent: Jul. 5, 2022

(54) AUTOMATABLE CONNECTION TERMINAL AND METHOD FOR CONTACTING A CONDUCTOR

(71) Applicant: PHOENIX CONTACT GmbH & Co. KG, Blomberg (DE)

(72) Inventors: Christian Kloppenburg, Buren Wewelsburg (DE); Dennis Habirov, Bielefeld (DE); Heinz Reibke, Bad Salzzuflen (DE)

(73) Assignee: PHOENIX CONTACT GmbH & Co. KG, Blomberg (DE)

( * ) Notice: Subject to any disclaimer, the term of this patent is extended or adjusted under 35 U.S.C. 154(b) by 0 days.

(21) Appl. No.: 17/048,968

(22) PCT Filed: Apr. 15, 2019

(86) PCT No.: PCT/EP2019/059639
§ 371 (c)(1),
(2) Date: Oct. 19, 2020

(87) PCT Pub. No.: WO2019/201841
PCT Pub. Date: Oct. 24, 2019

(65) Prior Publication Data

US 2021/0151906 A1 May 20, 2021

(30) Foreign Application Priority Data

Apr. 20, 2018 (DE) ..... 102018109489.2

(51) Int. Cl.
*H01R 4/242* (2018.01)
*H01R 13/506* (2006.01)
*H01R 43/22* (2006.01)

(52) U.S. Cl.
CPC ..... *H01R 4/242* (2013.01); *H01R 13/506* (2013.01); *H01R 43/22* (2013.01)

(58) Field of Classification Search
CPC ..... H01R 4/242; H01R 13/506; H01R 43/22; H01R 9/26; H01R 4/2433; H01R 43/01
See application file for complete search history.

(56) References Cited

U.S. PATENT DOCUMENTS 6,120,315 A * 9/2000 Gaertner ..... H01R 4/2433 439/395
6,527,580 B1 * 3/2003 Suss ..... H01R 4/2433 439/417

(Continued)

FOREIGN PATENT DOCUMENTS

DE 268089 5/1989
DE 19628116 10/1997

(Continued)

OTHER PUBLICATIONS

PCT Search Report for corresponding PCT International Application No. PCT/EP2019/059639 dated Jul. 1, 2019, 14 pages.

(Continued)

*Primary Examiner* — Tho D Ta
(74) *Attorney, Agent, or Firm* — Lee & Hayes, P.C.

(57) ABSTRACT

A connection terminal includes a housing, a slide, and an insulation displacement contact. At least portions of the slide and the insulation displacement contact are received in the housing. The slide has an opening for inserting a conductor to be contacted. The slide is movable from a first position toward the insulation displacement contact to a second position in order to engage the insulation displacement contact with the conductor to be contacted. The slide has a tool abutment configured to transmit, to the slide, an assembly force of a robot-guided assembly tool for moving the slide from the first position to the second position.

12 Claims, 5 Drawing Sheets

(56) References Cited

U.S. PATENT DOCUMENTS

| | | | | |
|---|---|---|---|---|
| 7,344,404 | B2 * | 3/2008 | Wilinski | H01R 4/2433<br>439/409 |
| 2013/0029542 | A1 * | 1/2013 | Kraemer | H01R 4/4809<br>439/843 |

FOREIGN PATENT DOCUMENTS

| | | |
|---|---|---|
| DE | 10039961 | 2/2002 |
| DE | 20214727 | 2/2003 |
| DE | 10256719 | 7/2004 |
| DE | 102008031154 | 1/2009 |
| DE | 202009013342 | 2/2011 |
| DE | 202016003374 | 8/2016 |
| EP | 0833417 | 4/1998 |
| EP | 1542317 | 6/2005 |

OTHER PUBLICATIONS

PCT International Preliminary Report on Patentability for corresponding PCT Application No. PCT/EP2019/059639 dated Oct. 29, 2020, 11 pages.

* cited by examiner

AUTOMATABLE CONNECTION TERMINAL AND METHOD FOR CONTACTING A CONDUCTOR

This Application claims priority to PCT Application No. PCT/EP2019/059639, filed Apr. 15, 2019, which claims priority to German Patent Application No. 10 2018 109489.2, filed Apr. 20, 2018, the contents of each of which is incorporated herein by reference.

The present invention relates to a connection terminal and a method for contacting a conductor using such a connection terminal.

The contacting of conductors on connection terminals is usually carried out manually because, due to the mechanical connection technology used, the connection terminals cannot be coupled fully automatically to wire ends. In addition, wire ends are usually prepared manually for connecting.

For example, a conductor to be contacted is initially stripped at the conductor end in order to expose the conducting core. The exposed end is then equipped with a ferrule in order to ensure reliable insertion and contacting in the region of the clamping point. The conductor end can be immobilized by screwing it to a clamping jaw, or, if it is a push-in or direct connection, by inserting the conductor into a terminal opening, wherein the insertion movement effects the clamping of the conductor end by triggering a mechanical clamping mechanism.

This is disadvantageous because both the manual conductor preparation and the manual connecting are time-consuming and thus cost-intensive. Against this backdrop, the present invention addresses the technical problem of providing a connection terminal and a method for contacting a conductor, which do not, or at least to a lesser extent, exhibit the aforementioned disadvantages, and particularly allow for an automated terminal assignment.

The above-described technical problem is solved by a connection terminal according to claim 1 and a method according to claim 9. Further embodiments are disclosed in the dependent claims and the following description.

According to a first aspect, the invention relates to a connection terminal comprising a housing, a slide and an insulation displacement contact, wherein at least portions of the slide and the insulation displacement contact are received in the housing, wherein the slide has an opening for inserting a conductor to be contacted, wherein the slide can be moved from a first position toward the insulation displacement contact to a second position in order to engage the insulation displacement contact with the conductor to be contacted, and wherein the slide has a tool abutment which is designed to transmit, to the slide, an assembly force of a particularly robot-guided assembly tool for moving the slide from the first position to the second position.

Due to the tool abutment, the connection terminal is therefore suitable for automated contacting of a conductor, wherein a conductor also does not have to be stripped or prepared prior to the contacting because an insulation displacement contact is provided. The connection terminal thus allows for quick automated contacting of a conductor.

The housing can have a guide in order to guide the slide in a straight line from the first position to the second position. For example, one or more guide surfaces can be provided on the housing, along which guide surfaces the slide is guided from the first position to the second position. Such a guide, particularly a linear guide, allows in a simple manner for the automation of the movement from the first position to the second position.

Alternatively or additionally, the slide can be pivotable about a pivot axis in order to be transferred from the first position to the second position. In order to transfer the slide from the first position to the second position, it can thus be moved, at least to some extent or entirely, in a rotatory manner.

The insulation displacement contact can be formed, to some extent or entirely, from a metal material.

The insulation displacement contact can be fastened to the housing in a form-locking manner. The insulation displacement contact can have one or more retaining portions which are inserted into grooves or recesses in the housing and immobilize the insulation displacement contact on the housing in a form-locking manner.

According to a further embodiment of the connection terminal, the housing has a further tool abutment for supporting the assembly tool during the movement of the slide from the first position to the second position. For example, a support force resulting from the assembly force can be supported particularly entirely on the housing. This makes an automated moving of the slide from the first position to the second position possible without the assembly forces acting on surrounding components adjacent to the housing. If, in the fully assembled state, the connection terminal is fastened, for example, to a retaining device, such as a mounting wall, a mounting rail, a support rail, or the like, none of the reaction forces, resulting from the assembly force, act from the connection terminal on the retaining device when the slide is transferred from the first position to the second position because the assembly force is supported on the further tool abutment of the housing.

According to a further embodiment of the connection terminal, the tool abutment of the slide and the further tool abutment of the housing face one another and delimit a seat for inserting a spreading tool. For example, the tool abutment of the slide and the further tool abutment of the housing can, in the first position, delimit a tubular opening, into which a spreading tool can be inserted, which is spike-shaped in the closed state.

The opening can particularly be circular cylindrical in order to facilitate a threading of a spreading tool which, in the closed state, also has a substantially circular cylindrical shape. The spreading tool can have two prongs which, when viewed in cross section, complement each other to form a circular shape, when the tool is in its closed state. Depending on the case of application, such an opening, according to further embodiments, can have a rectangular, oval, triangular, or asymmetrical cross-sectional shape. This equally applies to the cross-sectional shape of a spreading tool in the closed state.

In the first position of the slide, a spreading tool can thus be inserted into the seat. When the spreading tool is opened, the slide is transferred from the first position to the second position, wherein, in the second position of the slide, the tool abutment of the slide and the further tool abutment of the housing were moved away from one another by the spreading stroke of the spreading tool. In this case, the assembly forces required for moving the slide and for cutting the insulating sheathing of the conductor to be contacted in the course of this movement, are supported on the housing via the further tool abutment of the slide.

Alternatively, the tool abutment of the slide and the further tool abutment of the housing can be spaced apart from one another and each form a seat for inserting a pressing tool. For example, in the first position of the slide, the tool abutment of the slide and the further tool abutment of the housing can each be designed to receive the prongs of an opened pressing tool.

In the first position of the slide, a pressing tool can thus be inserted by its prongs into the particular seat. A closure of the pressing tool effects a transfer of the slide from the first position to the second position, wherein, in the second position of the slide, the tool abutment of the slide and the further tool abutment of the housing were moved toward one another by the pressing stroke of the pressing tool. In this case, the assembly forces required for moving the slide and for cutting the insulating sheathing of the conductor to be contacted in the course of this movement are supported on the housing by means of the further tool abutment of the slide.

Alternatively, only one tool abutment can be provided on the slide, but no tool abutment is provided on the housing. In this case, the assembly forces are supported by a retaining device, to which the housing is fastened, when the slide is transferred from the first position to the second position.

According to a further embodiment of the connection terminal, the opening in the slide is part of a tubular conductor seat which extends in a straight line. Such a conductor seat facilitates an automated insertion of a conductor because it can be inserted by means of a straight-line movement without deforming the conductor during insertion.

In particular, the conductor seat can extend parallel to a seat for inserting a tool, so that particularly a simultaneous automated insertion of a conductor, or a conductor end, to be contacted and the tool can take place on the slide. Such an arrangement thus allows for short process times for the automated contacting of a conductor or a conductor end within the connection terminal.

Alternatively, the opening in the slide can be part of a tubular conductor seat which extends at least in portions in a curved manner. As a result, an end portion of a conductor to be contacted can be deformed by an insertion movement along a curvature of the conductor seat, so that the conductor end is deflected, for example, by 90° with regard to the part of the conductor arranged in the opening in the slide. Such a design is useful, for example, when the slide is intended to be moved from the first position by moving into the housing in the direction of the insulation displacement tool in order to contact the conductor end. This ensures that, as in the previously described embodiments, the longitudinal extension of the conductor end portion to be contacted is oriented transversely to the movement direction of the slide from the first position to the second position. As a result, the sheathing of the conductor to be cut faces the insulation displacement tool.

According to a further embodiment of the connection terminal, the slide has a recess for receiving the insulation displacement tool, wherein, at least in the second position of the slide, the insulation displacement tool extends into the recess in the slide in a protruding manner.

In particular, a conductor seat can be provided on the slide on both sides of the recess, so that a conductor received in the conductor seat rests on both sides and spans the recess. When the insulation displacement contact cuts into the sheathing of the conductor, the conductor is thus supported on both sides of the insulation displacement tool in order to allow for reliable contacting without a kinking of the conductor end portion.

The insulation displacement tool can have cutting edges protruding in a fork-shaped manner in order to encase and contact a conductor to be contacted on two sides. As a result, the cutting edges can delimit a cutting gap, into which a conductor to be contacted or a conductor end of a conductor to be contacted is inserted as a result of the movement of the slide from the first position to the second position.

According to a further embodiment of the connection terminal, a snap-in device is provided in order to hold the slide in the first position in a form-locking and/or force-locking manner. This ensures that the slide remains reliably in the first position during transport, during assembly of the connection terminal, and during the preferably automated insertion of a conductor to be contacted into the opening in the slide. The snap-in device can have e.g. a tongue and groove, between which a snap-in connection is formed which is releasable by an application of force with a minimum tensile force.

Alternatively or additionally, a snap-in connection can be provided in order to hold the slide in the second position in a form-locking and/or force-locking manner. This ensures that the slide remains reliably in the second position in order to ensure permanent contacting between the insulation displacement contact and the conductor to be contacted. The snap-in device can have e.g. a tongue and groove, between which a snap-in connection is formed which is releasable by an application of force with a minimum tensile force.

For example, a first groove can be provided on a slide, which engages in the first position with a first tongue of the housing. With the use of an assembly tool, a tensile force can be introduced into the snap-in connection in order to drive the tongue and groove apart in a damage-free manner and to move the slide from the first position to the second position. In the second position, a second groove formed on the slide can interlock with a second tongue of the housing in order to immobilize the slide in the second position. The second snap-in connection is also releasable particularly in a damage-free manner by exceeding a minimum tensile force.

According to a second aspect, the invention relates to a method for contacting a conductor, comprising the following method steps: providing a connection terminal, wherein the connection terminal is designed according to the invention; providing a conductor to be contacted; inserting the conductor into the opening in the slide; moving the slide from a first position toward the insulation displacement contact to a second position in order to engage the insulation displacement contact with the conductor to be contacted, wherein the insulation displacement contact cuts an insulation of the conductor and is brought to bear against a conducting core of the conductor, and wherein the slide is moved automatically using the assembly tool of a robot.

The use of a connection terminal according to the invention allows for automated contacting of a conductor, wherein a conductor portion of the conductor does not have to be stripped or prepared prior to the contacting because an insulation displacement contact is provided. Therefore, automated contacting of a conductor is made possible in a short process time.

It is understood that method steps described with reference to the connection terminal according to the invention can be developments of the method according to the invention.

According to a further embodiment of the method, the provided connection terminal is fastened to a retaining device, such as a mounting wall, a mounting rail, or the like, and the housing of the connection terminal has a further tool abutment in order to support the assembly tool on the housing when the slide is moved from the first position to the second position, wherein an assembly force of the assembly tool is substantially entirely supported on the housing, so that substantially no forces are introduced into the retaining device when the slide is moved.

Since substantially no assembly forces are diverted to the retaining device, it will not bend mechanically, and therefore reliable, particularly robot-supported, contacting along a predefined assembly path is provided, and the contacting does not have to be additionally verified.

The wording "substantially no forces" presently indicates that less than 10% of the reaction forces required for supporting the assembly forces are introduced into the retaining device, particularly that less than 5% of the reaction forces required for supporting the assembly forces are introduced into the retaining device, more particularly that less than 2% of the reaction forces required for supporting the assembly forces are introduced into the retaining device.

A further embodiment of the method is characterized in that the movement of the slide from the first position to the second position is a straight-line movement. Such a movement can be carried out automatically in a simple manner.

As already described above, the assembly tool can be a spreading tool that performs a spreading movement, or the assembly tool can be a pressing tool that performs a closing movement or a pressing movement.

Alternatively, only a pushing of the slide toward the insulation displacement contact from a first position, protruding from the housing, to a second position, partially or entirely recessed in the housing, can take place.

A further embodiment of the method is characterized in that the conductor to be contacted is not pretreated, particularly not stripped and/or particularly not provided with a ferrule, prior to the insertion of the conductor into the opening in the slide. As a result, quick, particularly fully automated, contacting of the conductor can be achieved.

In the following, the invention shall be described in more detail by means of drawings showing embodiments. In the drawings, shown schematically:

Figure 1:
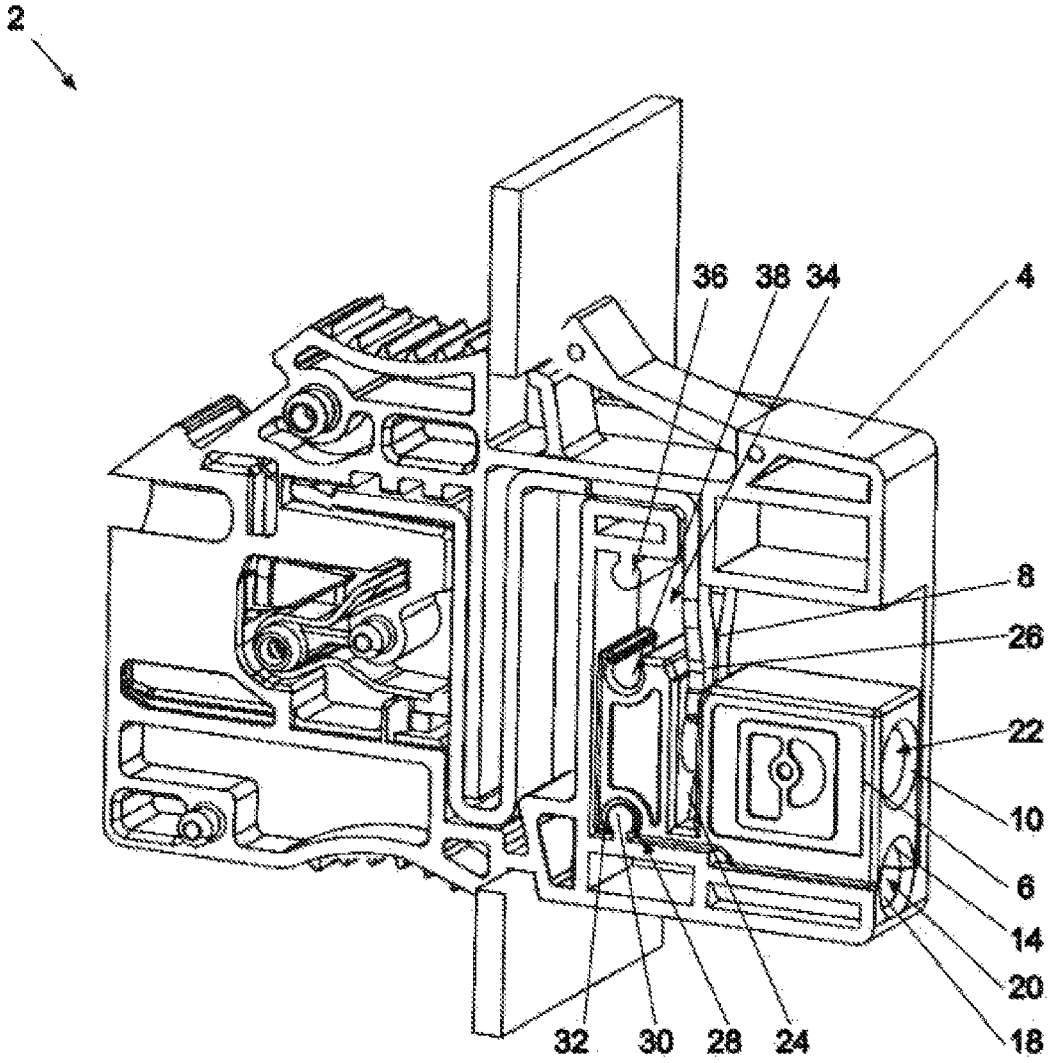
FIG. 1 is a perspective view of a connection terminal according to the invention.

FIG. 1 is a perspective view of a connection terminal 2 according to the invention. The connection terminal 2 comprises a housing 4, a slide 6, and an insulation displacement contact 8. At least portions of the slide 6 and the insulation displacement contact 8 are received in the housing 4. The slide 6 has an opening 10 for inserting a conductor 12 to be contacted.

Figure 5:
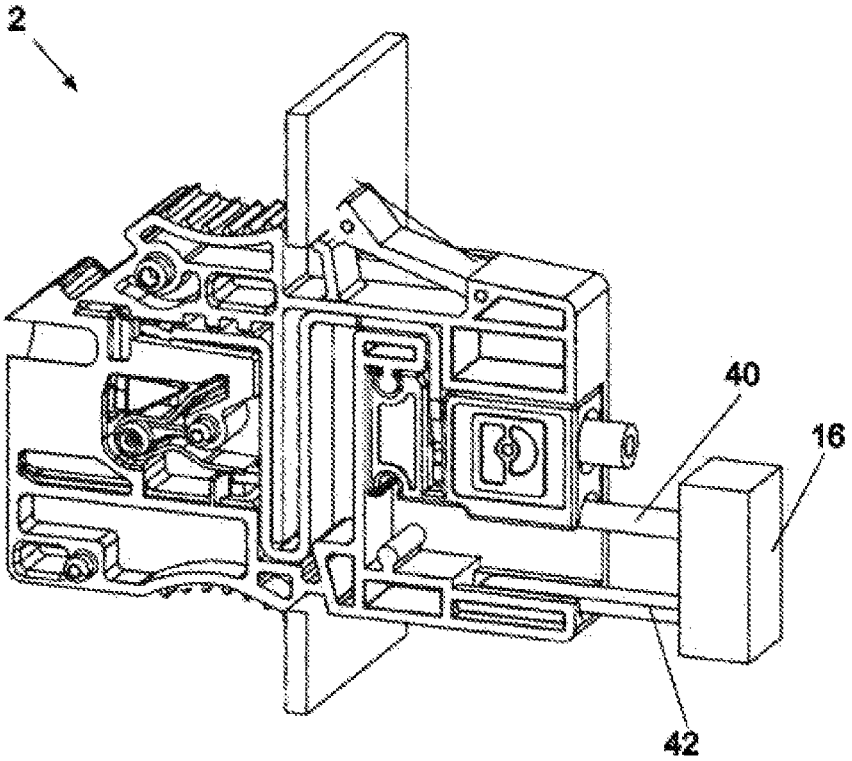
FIG. 5 is the connection terminal from FIG. 1 with a conductor to be contacted and a tool.

The slide 6 can be moved from a first position (FIG. 1) toward the insulation displacement contact 8 to a second position (FIG. 5). In this manner, the insulation displacement contact 6 engages with the conductor 12 to be contacted.

Figure 3:
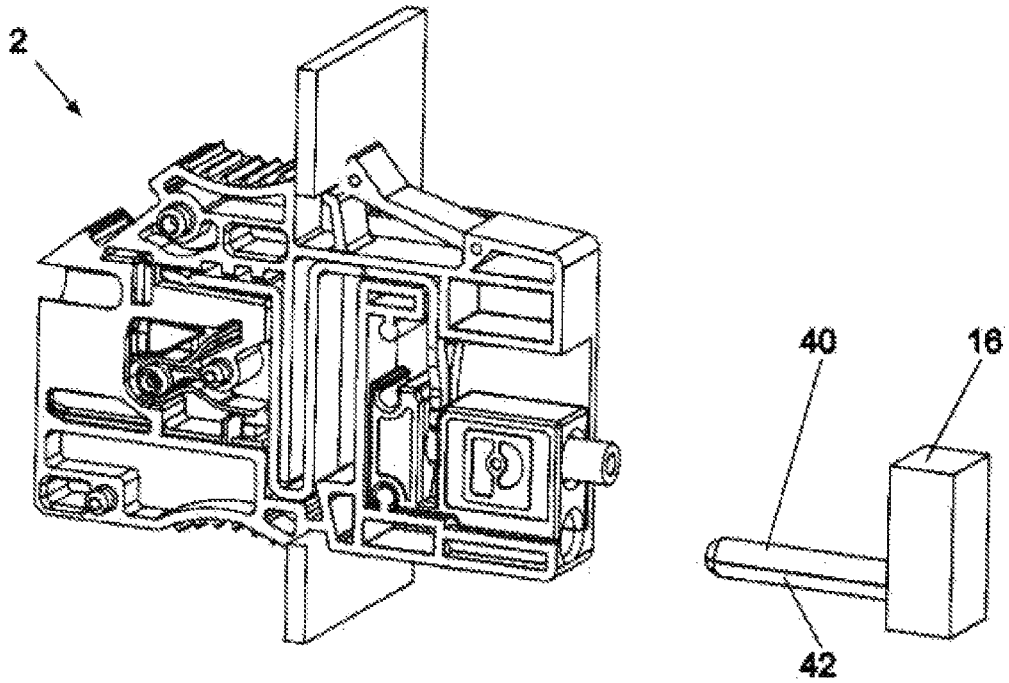
FIG. 3 is the connection terminal from FIG. 1 with a conductor to be contacted and a tool.
Figure 4:
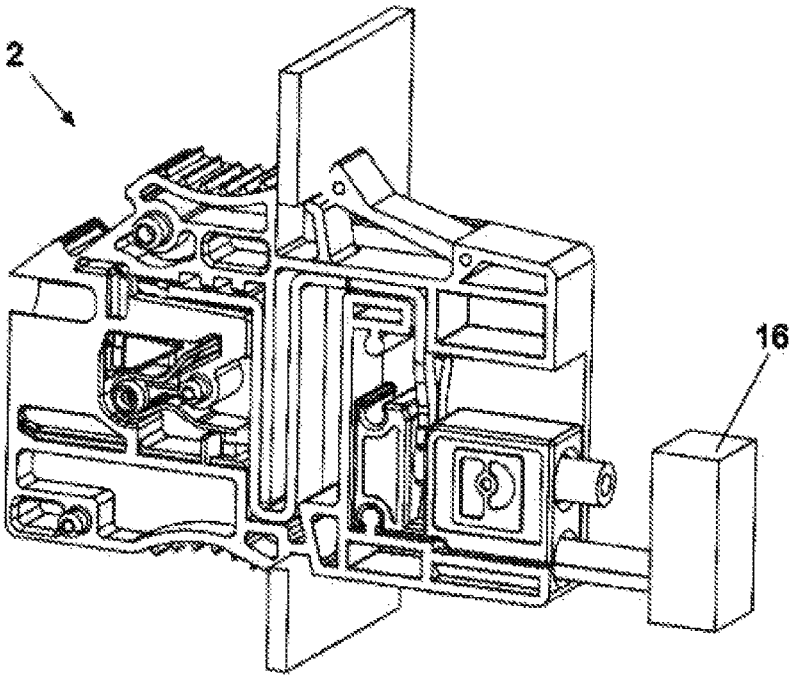
FIG. 4 is the connection terminal from FIG. 1 with a conductor to be contacted and a tool.

The slide 6 has a tool abutment 14 which is designed to transmit, to the slide 6, an assembly force of a robot-guided assembly tool 16 (FIG. 3) for moving the slide 6 from the first position to the second position.

In addition to the tool abutment 14 of the slide 6, the housing 4 has a further tool abutment 18. The tool abutment 18 is used to support the assembly tool 16 on the housing 4 when the slide 6 is moved from the first position to the second position. In this manner, the assembly force introduced into the slide 5 by the tool 16 can be entirely supported on the housing 4, so that, when the slide 6 is moved from the first position to the second position, no forces act on a retaining device (not shown), to which the connection terminal 2 is fastened in the fully assembled state. The assembly force acting on the slide 6 and a resulting reaction force or support force acting on the tool abutment 14 cancel each other out with regard to a retaining device, to which the connection terminal 2 is fastened.

Presently, the tool abutment 14 of the slide 6 and the further tool abutment 18 of the housing 4 face one another in the first position of the slide 6 shown in FIG. 1 and delimit a tubular seat 20 for inserting the tool 16 designed as a spreading tool 16.

The opening 10 in the slide 6 is presently part of a tubular conductor seat 22 extending in a straight line. As seen when viewed along its longitudinal extension, the conductor seat 22 is presently oriented parallel to the tubular seat 20.

The slide 6 also has a recess 24 for receiving the insulation displacement tool 8. In the first position (FIG. 1) of the slide 6 and in the second position (FIG. 5) of the slide 6, the insulation displacement tool 8 extends into the seat 24 of the slide 6 in a protruding manner.

The insulation displacement tool 8 has cutting edges 26 protruding in a fork-shaped manner in order to encase and contact a conductor 12 to be contacted on two sides.

The connection terminal 2 has a snap-in device 28 in order to hold the slide 6 in the first position in a form-locking and/or force-locking manner. The snap-in device 28 has a tongue 30 formed on the housing 4 and a groove 32 provided on the slide 6, between which a snap-in connection is formed. A further snap-in device 34 is used to immobilized the slide 6 in the second position (FIG. 5), wherein the snap-in device 34 has a tongue 36 formed on the housing 4 and a groove 38 provided on the slide 6.

In the following, a method according to the invention for contacting the conductor 12 shall be described in more detail using FIG. 1-5.

In a first method step, the connection terminal 2 is initially provided. In this case, the slide 6 is in the first position shown in FIG. 1, wherein the slide 6 is held in the first position by the snap-in connection formed by the tongue 30 and the groove 32.

Figure 2:
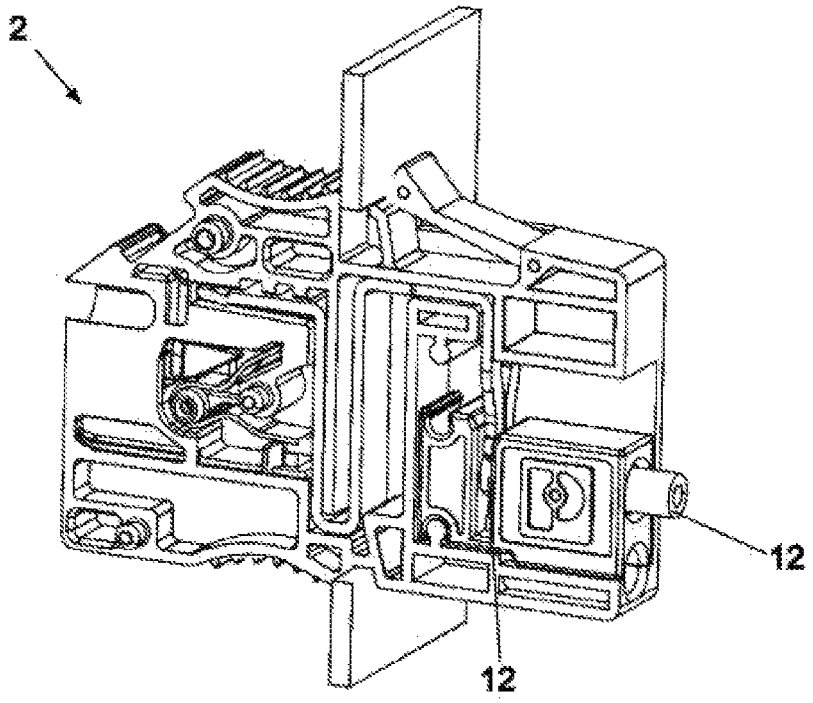
FIG. 2 is the connection terminal from FIG. 1 with a conductor to be contacted.

In a next method step, the conductor 12 to be contacted is provided and automatically inserted into the opening 10 in the slide 6 (FIG. 2). For this purpose, the conductor 12 extends along the conductor seat 22 over the recess 24, so that the conductor 12 is supported on two sides.

In a next method step (FIG. 3, FIG. 4), the spreading tool 16 is provided and inserted into the seat 20.

Subsequently (FIG. 5), the prongs 40, 42 of the spreading tool 16 are moved apart in order to move the slide 6 from the first position to the second position shown in FIG. 5. In such case, the insulation displacement contact 8 engages with the conductor 12, wherein the insulation displacement contact 8 cuts an insulation of the conductor 12 and is brought to bear against a conducting core of the conductor 12. The slide 6 is moved automatically by means of the assembly tool 16 attached to a robot. The movement of the slide 6 from the first position to the second position is presently a straight-line movement.

Figure 6:
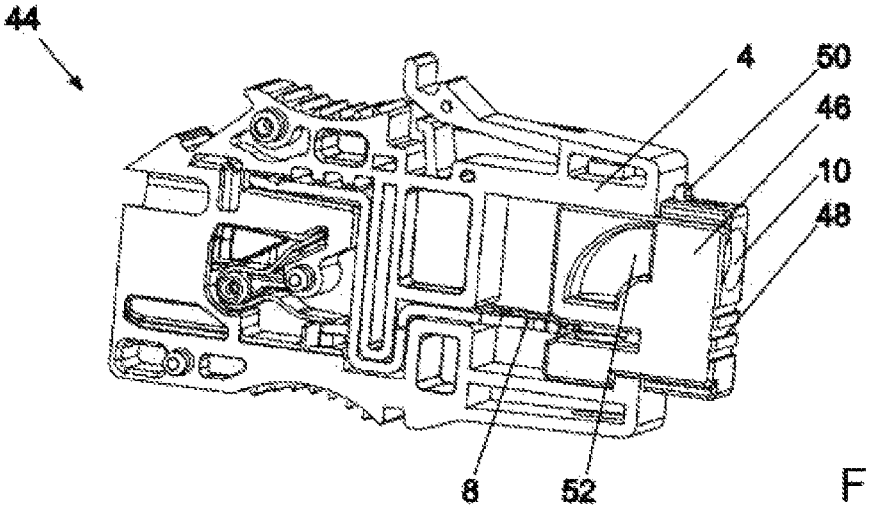
FIG. 6 is a perspective view of a further connection terminal according to the invention.
Figure 7:
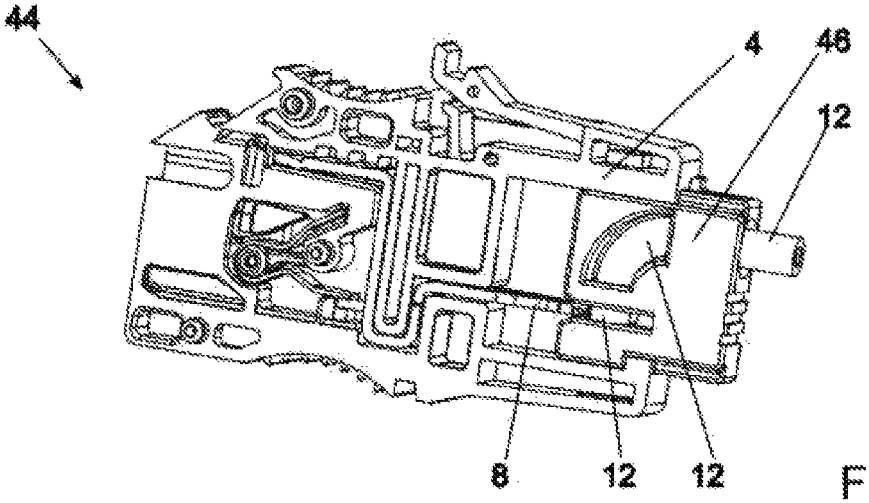
FIG. 7 is the connection terminal from FIG. 6 with a conductor to be contacted.
Figure 8:
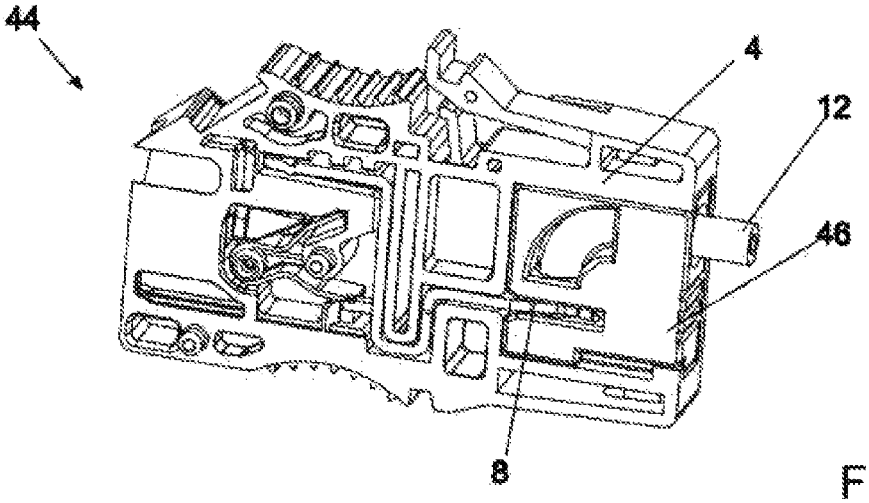
FIG. 8 is the connection terminal from FIG. 6 with a conductor to be contacted.

FIGS. 6, 7, and 8 describe a further connection terminal 44 according to the invention in a perspective view. In order to avoid repetitions, only the differences with regard to the previously described embodiment shall be described in the following, wherein the same features are denoted with the same reference signs.

The connection terminal 44 has a slide 46, the first position of which is shown in FIG. 6. In the first position, at least one portion of the slide 46 extends beyond the housing 2 in a protruding manner.

The slide 46 has a tool abutment 48 which is designed to transmit, to the slide 46, an assembly force of a robot-guided assembly tool for moving the slide 46 from the first position (FIG. 6) to the second position (FIG. 8). For moving the slide 46 from the first position to the second position, a compression force is applied on one side to the tool abutment 48 of the slide 46, so that the slide 46 is moved into the housing 2. For this purpose, a snap-in device 50 initially forms a resistance, wherein the snap-in device can be displaced in the direction of the slide 6 by applying a minimum force.

In contrast to the initially described embodiment, the slide 46 has a tubular conductor seat 52 extending in a curved manner. A conductor 12 is thus deformed on one side by an insertion into the conductor seat 52, so that the outer lateral surface of the conductor 12 faces the insulation displacement tool 8.

Moving the slide 46 into the housing 2 thus effects contacting of the conductor 12 with the insulation displacement contact 8, analogous to the embodiment described with FIG. 1-5.

Figure 9:
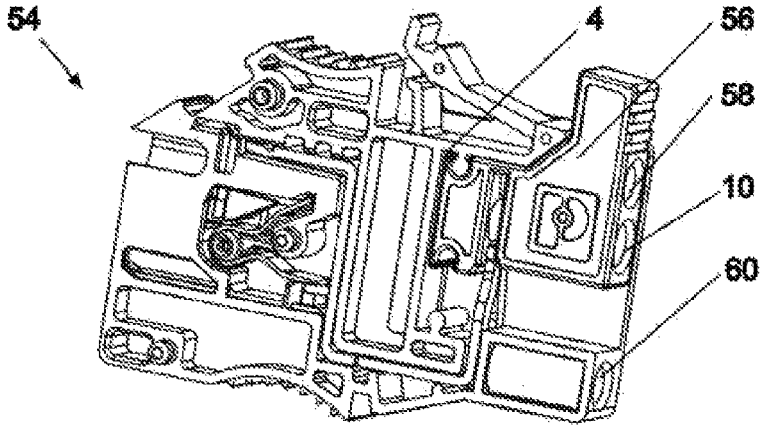
FIG. 9 is a perspective view of a further connection terminal according to the invention.
Figure 10:
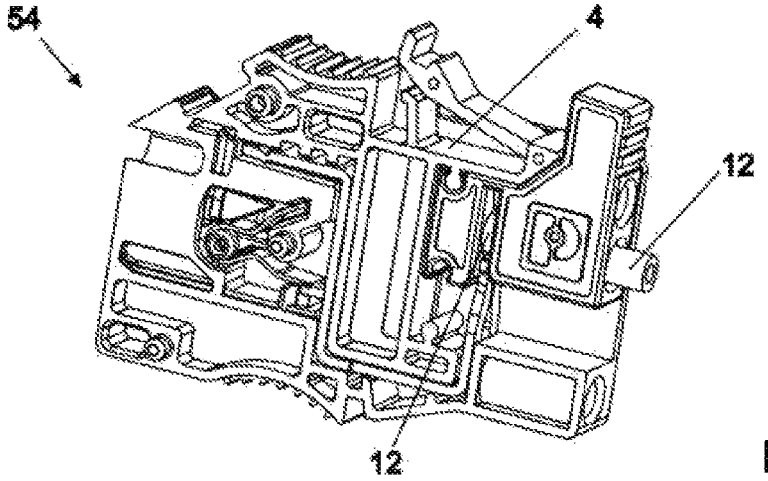
FIG. 10 is the connection terminal from FIG. 9 with a conductor to be contacted.
Figure 11:
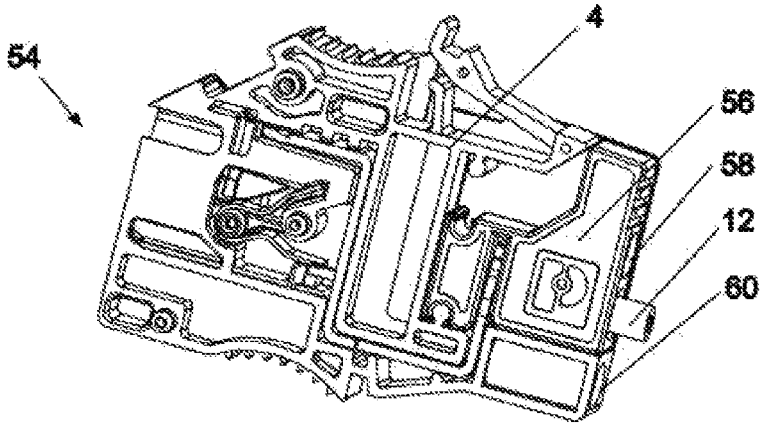
FIG. 11 is the connection terminal from FIG. 9 with a conductor to be contacted.

FIGS. 9, 10, and 11 show a further embodiment of a connection terminal 54 according to the invention which differs from the embodiment described with reference to FIG. 1-5 in that the slide 56 can be moved from the first position shown in FIG. 9 to the second position shown in FIG. 11 by means of a pressing tool.

A tool abutment 58 of the slide 56 and a tool abutment 60 of the housing 2 in the first position shown in FIG. 9 are initially arranged apart from one another by a pressing stroke to be executed, and they are moved toward one another by the insertion of prongs of a pressing tool into the seats 58, 60 and a subsequent bringing-together of the prongs. Therefore, a movement of the slide 56 toward the insulation displacement contact 8 is, contrary to the initially described embodiment, not effected by opening a spreading tool but by closing a pressing tool.

In this variant, the assembly forces and reaction forces also cancel each other out, so that a retaining device (not shown), on which the connection terminal is held in the fully assembled state, does not experience a load from assembly forces or resulting reaction forces.

REFERENCE SIGNS

2 Connection terminal
4 Housing
6 Slide
8 Insulation displacement contact
10 Opening
12 Conductor
14 Tool abutment
16 Assembly tool
18 Tool abutment
20 Seat
22 Conductor seat
24 Recess
26 Cutting edges
28 Snap-in device
30 Tongue
32 Groove
34 Snap-in device
36 Tongue
38 Groove
40 Prong
42 Prong
44 Connection terminal
46 Slide
48 Tool abutment
50 Snap-in device
52 Conductor seat
54 Connection terminal
56 Slide
58 Tool abutment
60 Tool abutment

The invention claimed is:

1. A connection terminal comprising:
a housing;
a slide; and
an insulation displacement contact;
wherein at least portions of the slide and the insulation displacement contact are received in the housing,
wherein the slide has an opening for inserting a conductor to be contacted,
wherein the slide is movable from a first position toward the insulation displacement contact to a second position to engage the insulation displacement contact with the conductor to be contacted,
wherein the slide has a first tool abutment configured to transmit, to the slide, an assembly force of a robot-guided assembly tool for moving the slide from the first position to the second position, and
wherein the housing has a second tool abutment to support the robot-guided assembly tool on the housing when the slide is moved from the first position to the second position.

2. The connection terminal according to claim 1, wherein the first tool abutment of the slide and the second tool abutment of the housing face one another and delimit a seat for inserting a spreading tool.

3. The connection terminal according to claim 1, wherein the first tool abutment of the slide and the second tool abutment of the housing are spaced apart from one another and each forms a seat for inserting a pressing tool.

4. The connection terminal according to claim 1, wherein the opening in the slide is part of a tubular conductor seat which extends:
in a straight line; or
at least in portions, curvingly.

5. The connection terminal according to claim 1, wherein the slide has a recess for receiving the insulation displacement contact, and
wherein, at least in the second position of the slide, the insulation displacement contact extends into the recess in the slide protrudingly.

6. The connection terminal according to claim 1, wherein the insulation displacement contact has cutting edges protruding in a fork shape to encase and contact the conductor to be contacted on two sides.

7. The connection terminal according to claim 1, further comprising a snap-in device to hold the slide, form-lockingly and/or force-lockingly, in:

the first position; and/or the second position.

8. A method for contacting a conductor, the method comprising steps of:

providing a connection terminal including:

a housing, a slide, and an insulation displacement contact, wherein at least portions of the slide and the insulation displacement contact are received in the housing, wherein the slide has an opening for inserting a conductor to be contacted, wherein the slide is movable from a first position toward the insulation displacement contact to a second position to engage the insulation displacement contact with the conductor to be contacted, wherein the slide has a first tool abutment configured to transmit, to the slide, an assembly force of a robot-guided assembly tool for moving the slide from the first position to the second position, and wherein the housing has a second tool abutment to support the robot-guided assembly tool on the housing when the slide is moved from the first position to the second position;

providing the conductor to be contacted;

inserting the conductor to be contacted into the opening in the slide; and moving the slide from the first position toward the insulation displacement contact to the second position in order to engage the insulation displacement contact with the conductor to be contacted, wherein the insulation displacement contact cuts an insulation of the conductor to be contacted and is brought to bear against a conducting core of the conductor to be contacted, and wherein the slide is moved automatically using the robot-guided assembly tool.

9. The method according to claim 8, wherein:

the connection terminal is fastened to a retaining device that is one of a mounting wall, a mounting rail, or a support rail, and wherein an assembly force of the robot-guided assembly tool is substantially entirely supported on the housing, so that substantially no forces are introduced into the retaining device when the slide is moved.

10. The method according to claim 8, wherein a movement of the slide from the first position to the second position is a straight-line movement, and/or wherein the robot-guided assembly tool is a spreading tool that performs a spreading movement, or the robot-guided assembly tool is a pressing tool that performs a closing movement.

11. The method according to claim 8, wherein the conductor to be contacted is not pretreated, stripped, and/or provided with a ferrule, prior to insertion of the conductor to be contacted into the opening in the slide.

12. A method for contacting a conductor, the method comprising steps of:

providing a connection terminal including:

a housing, a slide, and an insulation displacement contact, wherein at least portions of the slide and the insulation displacement contact are received in the housing, wherein the slide has an opening for inserting a conductor to be contacted, wherein the slide is movable from a first position toward the insulation displacement contact to a second position to engage the insulation displacement contact with the conductor to be contacted, and wherein the slide has a tool abutment configured to transmit, to the slide, an assembly force of a robot-guided assembly tool for moving the slide from the first position to the second position, providing the conductor to be contacted;

inserting the conductor to be contacted into the opening in the slide; and moving the slide from the first position toward the insulation displacement contact to the second position in order to engage the insulation displacement contact with the conductor to be contacted, wherein the insulation displacement contact cuts an insulation of the conductor to be contacted and is brought to bear against a conducting core of the conductor to be contacted, and wherein the slide is moved automatically using the robot-guided assembly tool.

* * * * *